US006481142B1

(12) United States Patent
McCarthy

(10) Patent No.: US 6,481,142 B1
(45) Date of Patent: Nov. 19, 2002

(54) LOCK FOR A GUN STOCK RECOIL REDUCTION DEVICE

(76) Inventor: Patrick M. McCarthy, 18227 Goudy Rd., Dalton, OH (US) 44618

( * ) Notice: Subject to any disclaimer, the term of this patent is extended or adjusted under 35 U.S.C. 154(b) by 0 days.

(21) Appl. No.: 09/705,328

(22) Filed: Nov. 3, 2000

(51) Int. Cl.[7] ..... F41C 23/00
(52) U.S. Cl. ..... 42/74
(58) Field of Search ..... 42/71.01, 73, 74; 89/187.02

(56) References Cited

U.S. PATENT DOCUMENTS 3,137,958 A * 6/1964 Lewis
3,461,589 A 8/1969 Vironda ..... 42/74
3,507,528 A * 4/1970 Desmarchais
3,738,219 A * 6/1973 Febres
3,761,117 A * 9/1973 Shendure
3,795,998 A * 3/1974 Kuhl
4,922,640 A * 5/1990 Toombs
5,031,348 A * 7/1991 Carey
5,259,137 A * 11/1993 Blenk et al.
5,339,789 A 8/1994 Heitz ..... 124/56
5,367,812 A * 11/1994 Lautrec
5,410,833 A 5/1995 Paterson ..... 42/73
5,447,092 A * 9/1995 Dobbins
5,491,917 A 2/1996 Dilhan et al. ..... 42/106
5,682,007 A * 10/1997 Dobbins
5,974,718 A * 11/1999 Bentley et al.
6,238,292 B1 * 5/2001 Pelkey

* cited by examiner

*Primary Examiner*—Michael J. Carone
*Assistant Examiner*—Troy Chambers
(74) *Attorney, Agent, or Firm*—Sand & Sebolt

(57) ABSTRACT

A recoil reduction lock for a gun prevents a recoil reduction device from compressing until a shell is discharged. The lock is adjustable so that it may be used with different gun stocks. The lock may be configured to work with a wide variety of existing recoil reduction devices. The lock includes an inertia lock that prevents a gun stock from collapsing until the discharge of a shell moves the inertia lock to an unlocked position. The inertia lock rapidly returns to its resting position enabling the gun to be rapidly fired again.

21 Claims, 11 Drawing Sheets

LOCK FOR A GUN STOCK RECOIL REDUCTION DEVICE

BACKGROUND OF THE INVENTION

1. Technical Field

The invention relates generally to recoil reduction devices for guns and, more particularly, to a recoil reduction lock that prevents a recoil reduction device from operating until the gun is discharged. Specifically, the present invention relates to a recoil reduction lock for a shotgun stock that prevents a recoil reduction device from compressing until an inertia lock is released by the exploding shell.

2. Background Information

When a gun is to be fired, the user brings the butt of the gun up to his shoulder so that a firm surface is provided to support the gun. The firing of the weapon produces a recoil that is mostly transmitted back into the shooter's shoulder. Sport shooters who shoot hundreds or thousands of shells each month desire to reduce this recoil force by outfitting their guns with recoil reduction devices.

Many different types of recoil reduction devices are known in the art. These devices include mechanisms having a spring extending between the body and butt of the gun. The spring is configured to absorb a portion of the recoil when a shell is discharged. The problem with this type of mechanism is that the user often unintentionally compresses the spring as he snaps the gun up to his shoulder. The unintentional compression is often experienced by trap, skeet, and sporting clays sportsmen. The compression of the spring at this stage is undesirable because the user does not achieve a tight, secure mount against his shoulder. In addition, the unintentional compression of the spring can reduce the effectiveness of the recoil reduction device.

One such mechanism is disclosed in U.S. Pat. No. 5,491,917 granted to Dilhan. This patent discloses the use of a honeycomb type of shock absorber which collapses as the launch cylinder moves rearwardly after the projectile is launched. Vironda, U.S. Pat. No. 3,461,589, discloses the use of an inertia member positioned in a gun stock and held in place by a magnet. The system includes a check valve and spring to rapidly re-position the inertia member so that additional shells can be shot from the gun. Heitz, U.S. Pat. No. 5,339,789 discloses the use of a locking mechanism which aids in absorbing the recoil energy from the discharge of the gun.

U.S. Pat. No. 5,410,833 granted to Paterson on May 2, 1995, which patent is incorporated herein by reference, discloses a mechanism for absorbing the energy from the recoil of a gun by using parallel compression struts which are mounted between the body and butt of the gun. One of the struts includes a cylinder which is connected at one end to the butt of the gun. A shaft, which is connected at one end to the body of the gun, is receivable within the cylinder. A moveable plug is further included in the cylinder and the plug includes a strut which is adapted for longitudinal axial movement within the cylinder. A plurality of compressible disc-shaped springs are disposed in the cylinder between the plug and the butt of the gun. The springs are coaxially disposed in the shaft, around the strut, so that as the strut moves within the cylinder the strut can reciprocate through the central apertures of the spring. As the gun fires, the butt of the gun is compressed against the user's shoulder—telescoping the shaft further inside the cylinder. This compresses the springs, thereby absorbing the recoil energy.

SUMMARY OF THE INVENTION

The invention provides a recoil reduction lock for a gun that prevents a recoil reduction device from compressing until the shell is discharged. The lock is adjustable so that it may be used with different gun stocks. The lock may be configured to work with a wide variety of existing recoil reduction devices.

The invention provides an inertia lock that prevents a gun stock from collapsing until the discharge of a shell moves the inertia lock to an unlocked position. The inertia lock rapidly returns to its resting position enabling the gun to be rapidly fired again.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended claims.

Similar numerals refer to similar parts throughout the specification.

DETAILED DESCRIPTION OF THE DRAWINGS

Figure 1:
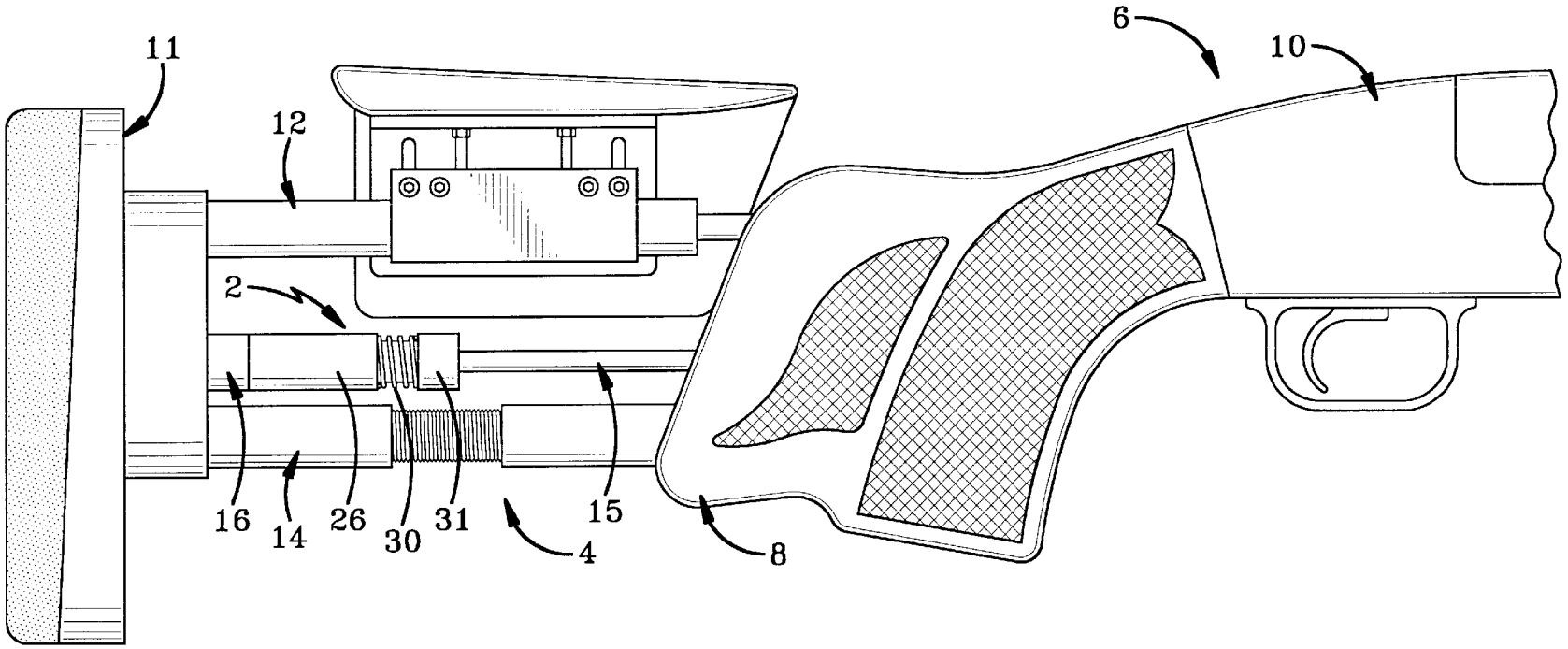
FIG. 1 is a front elevation view of the recoil reduction lock installed in a gun stock with a recoil reduction device.

The lock of the present invention is indicated generally by the numeral 2 in the accompanying drawings. Lock 2 prevents a recoil reduction device 4 from compressing until the gun 6 is discharged. Lock 2 is disposed in the gun stock 8 in cooperation with device 4.

Gun 6 includes a gun body 10 and a stock butt 11. Butt 11 is connected to the body 10 with the struts 12, 14 of recoil reduction device 4. The structure and operation of device 4 is disclosed in Paterson. Although Paterson discloses the use of a series of aligned bent plate springs to absorb the recoil, the drawings showing a coil spring 13 (FIG. 5A) that absorbs the recoil force. Lock 2 of the invention may be used with essentially any recoil reduction device 4 of this type and the Paterson device is disclosed only to provide an example.

Figure 2:
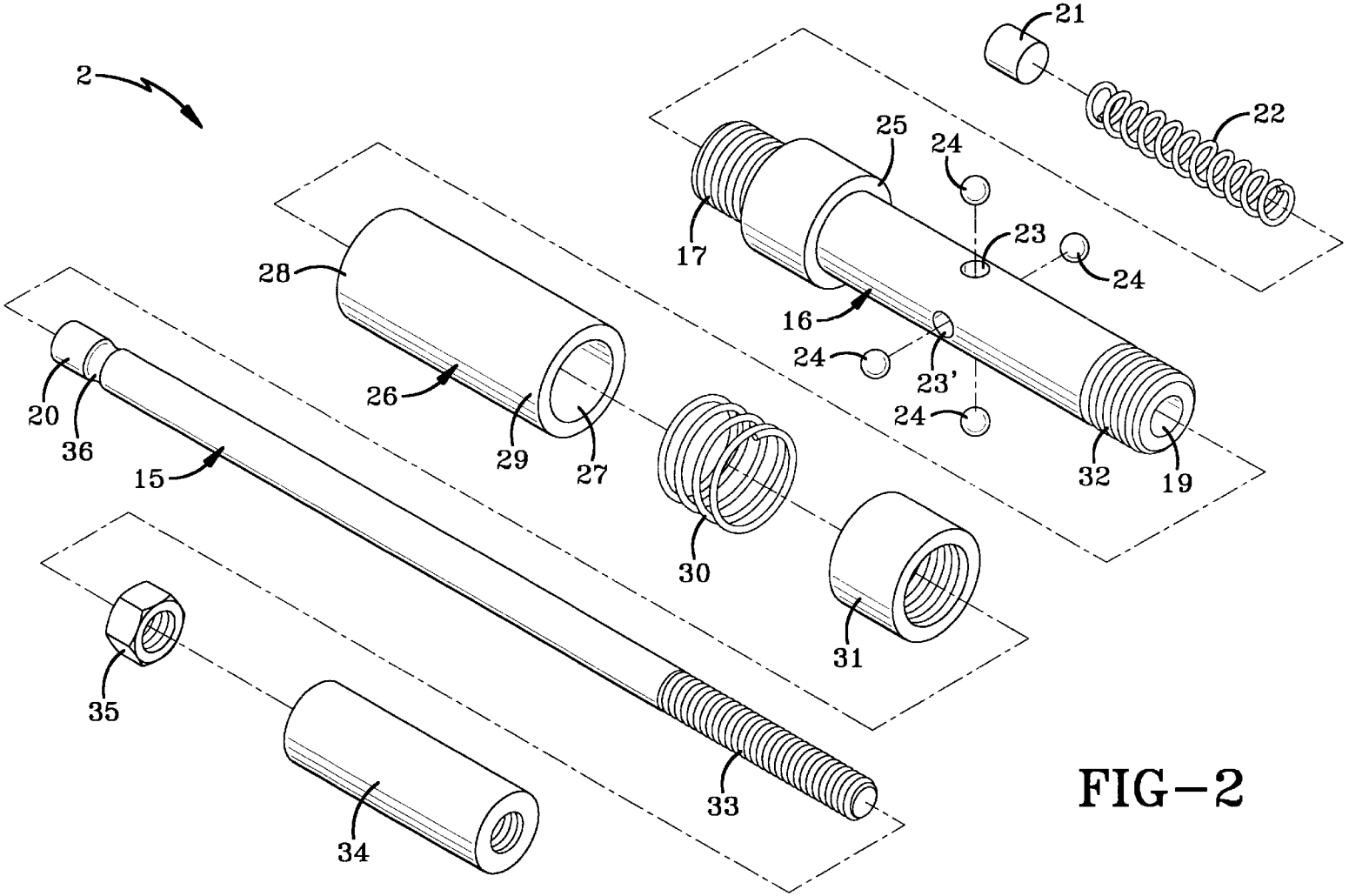
FIG. 2 is an exploded view of the recoil reduction lock.
Figure 3:
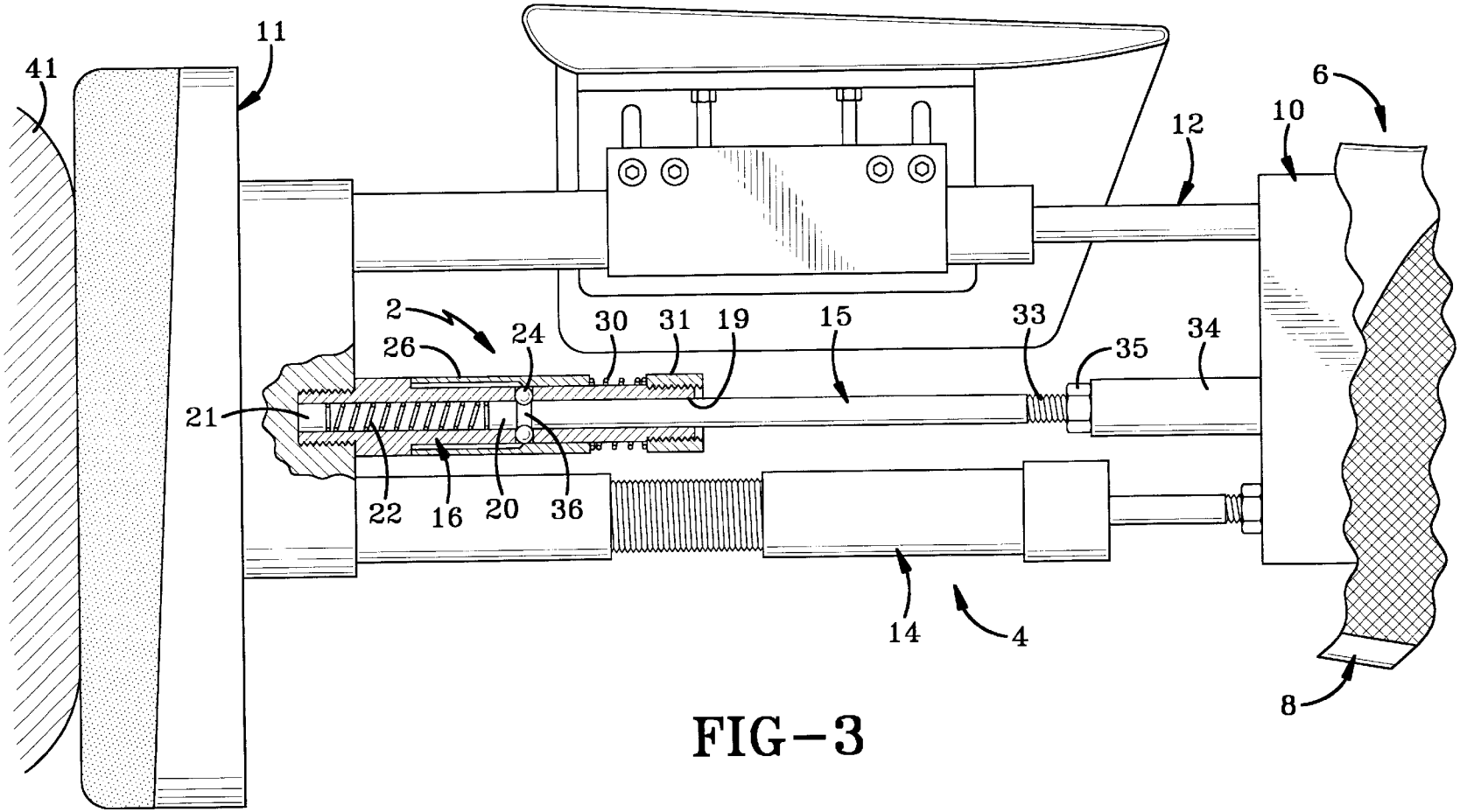
FIG. 3 is a front elevation view with a portion of the recoil reduction lock in section.

Referring to FIGS. 1, 2 and 3, lock 2 is connected at one end to body 10 of gun 6 and at its other end to butt 11 of the gun 6. Lock 2 generally includes a first member adapted to be connected to body 10 and a second member adapted to be connected to butt 11. A locking arrangement prevents the members from moving relative to each other before gun 6 is fired. Immediately after gun 6 is fired, the locking arrangement moves to an unlocked position to allow the members to move relative to each other. The locking arrangement is operated by using the recoil force generated by gun 6 when gun 6 is fired. The locking arrangement may thus include an inertia-type lock.

The first member of the exemplary embodiment of lock 2 is a shaft 15 having a first end and a second end. The second end of shaft 15 is adapted to be disposed closely adjacent or attached to body 10 of gun 6. The first end of shaft 15 is selectively slidably received in the second member of lock 2. In the exemplary embodiment, the second member of lock 2 is a sleeve 16. Sleeve 16 is adapted to be connected to butt 11 of gun 6.

Referring to FIG. 2, the first end 17 of first sleeve 16 is externally threaded and is adapted to be received into an internally threaded recess 18 in butt 11 of gun 6. In other embodiments of the invention, first sleeve 16 may be connected to butt 11 is other manners known to those skilled in the art. A longitudinal bore 19 is defined by first sleeve 16, and the first end 20 of shaft 15 is slidably received within bore 19. A stopper 21 and first spring 22 are disposed within bore 19 proximate first end 17 of first sleeve 16. Stopper 21 engages the interior of butt 11 (FIG. 3) and provides a firm surface against which the first spring 22 may be compressed. In other embodiments, spring 22 may directly engage butt 11 or bore 19 may be closed off adjacent end 17. First end 20 of shaft 15 engages first spring 22 in bore 19.

First sleeve 16 defines two passages 23, 23' disposed substantially perpendicular to bore 19 and substantially perpendicular to each other. Other numbers of passages and different angles of interaction of the passages are within the scope of this invention. Passages 23, 23' are adapted to receive ball bearings 24 in a manner that allows ball bearings 24 to slide radially inwardly and radially outward with respect to first sleeve 16.

First sleeve 16 further includes a step or shoulder 25 proximate first end 17. Shoulder 25 may be formed as an integral part of first sleeve 16 or may be a housing receivable over first sleeve 16 and secured against longitudinal motion in a suitable manner.

Figure 3A:
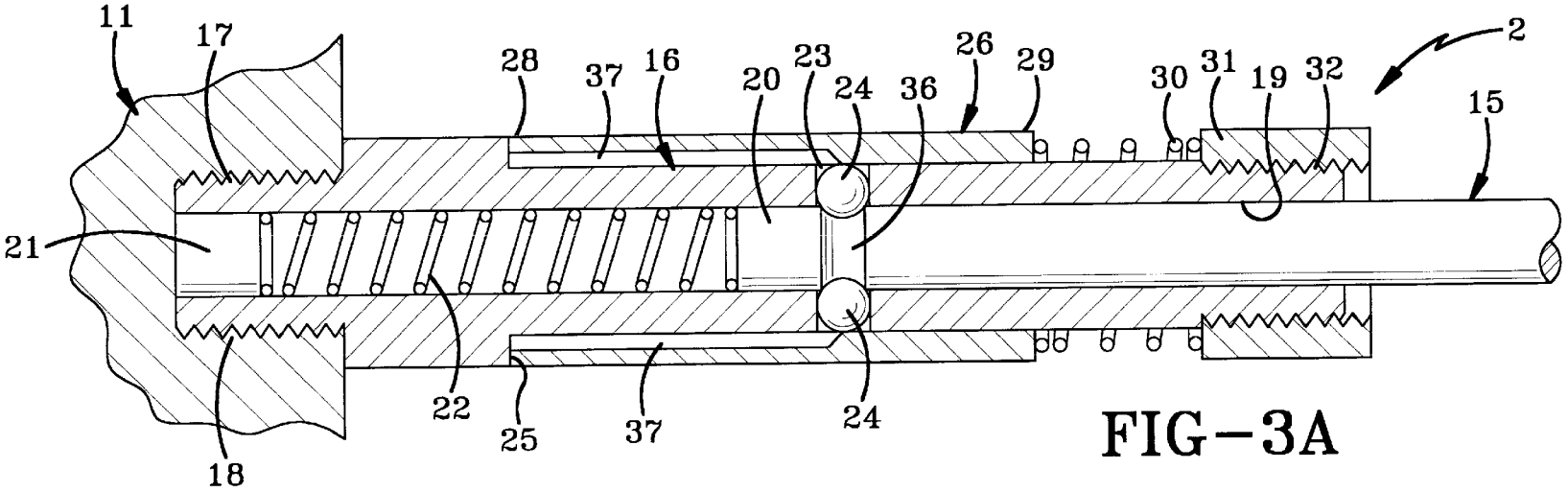
FIG. 3A is an enlarged cross sectional view of the lock in the locked position.
Figure 4B:
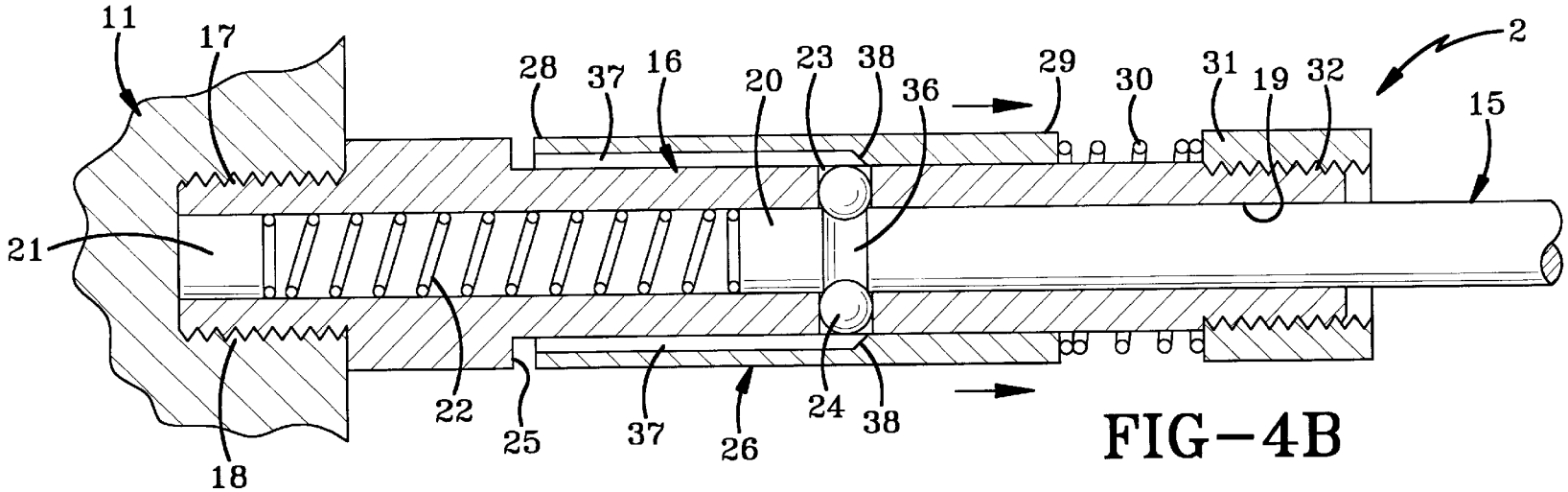
FIG. 4B is an enlarged cross sectional view of the lock in the unlocked position.
Figure 5:
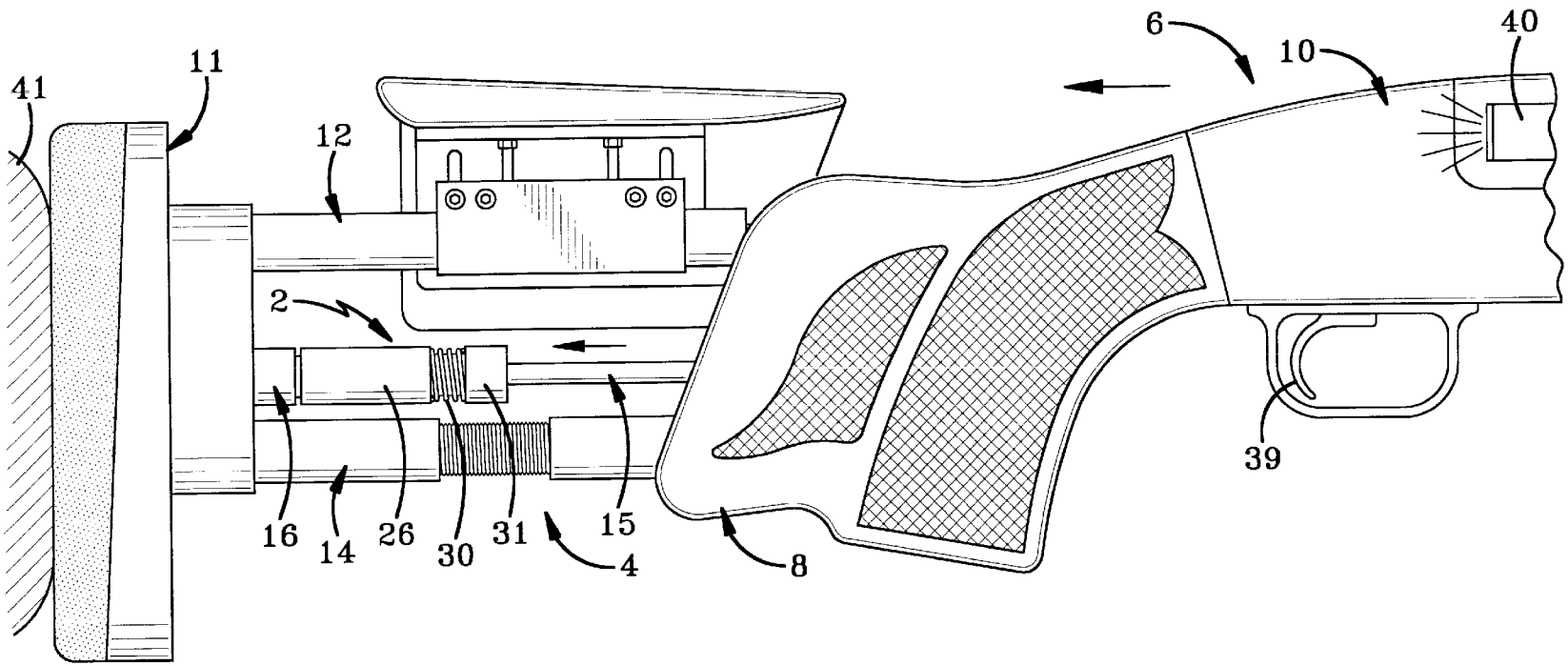
FIG. 5 is a front elevation view of the gun showing the recoil reduction device absorbing the recoil force.

A second sleeve 26 having an internal bore 27 is longitudinally and coaxially disposed around first sleeve 16. Second sleeve 26 is movable between locked (FIGS. 3A and 6B) and unlocked positions (FIGS. 4B and 5B). Second sleeve's internal bore 27 varies in diameter, having a greater diameter proximate the first end 28, and a lesser diameter proximate the second end 29 as shown in FIG. 3A. First end 28 of second sleeve 26 is adapted to abut shoulder 25 of first sleeve 16 and second end 29 engages a compression spring 30. An internally threaded nut 31 is provided to engage the externally threaded second end 32 of sleeve 16 thereby securing second sleeve 26 and compression spring 30 around first sleeve 16. A circumferential space 37 is disposed between first sleeve 16 and the section of larger diameter of second sleeve 26. An incline 38 is formed between the areas of greater and lesser diameter of the bore 27.

Shaft 15 defines a circumferential groove 36 proximate first end 20. Groove 36 is configured to seat ball bearings 24 in a position where ball bearings 24 are positioned in groove 36 and in passages 23, 23'. Groove 36 and incline 38 are positioned such that ball bearings 24 engage second sleeve 26 immediately adjacent incline 38 when second sleeve 26 is in the locked position.

In one embodiment of the invention, the second end 33 of shaft 15 is externally threaded and engages an internally threaded housing 34 and is secured therein by a locking nut 35. Housing 34 is secured to body 10 of gun 6 by any suitable means (not shown) such as threads, an interference fit, a frictional fit, an abutment, or the like. The length of shaft 15 may be adjusted by rotating nut locking 35 to cause the shaft to move longitudinally relative to housing 34. The adjustability of shaft 15 allows lock 2 to be used with different stocks 8 known in the art.

The device of the present invention works in the following manner.

Referring to FIG. 3A—when gun 6 is in the "at rest" position and lock 2 is in the locked position, first end 28 of the second sleeve 26 abuts shoulder 25. In this position, ball bearings 24 engage groove 36 of shaft 15 and the lesser diameter surface of second sleeve 26. This engagement locks second sleeve 26 and shaft 15 together. The ball bearings 24 disposed in the groove 36 are positioned immediately adjacent incline 38, but in the at rest position, ball bearings 24 are prevented from entering the space 37 between the first and second sleeves 16, 26. In this position, shaft 15 cannot slide with respect to first sleeve 16 and recoil reduction device 4 cannot be compressed. The shooter thus does not unintentionally compress stock 8 when the shooter quickly mounts stock 8 to his shoulder 41 (FIG. 3).

Figure 4:
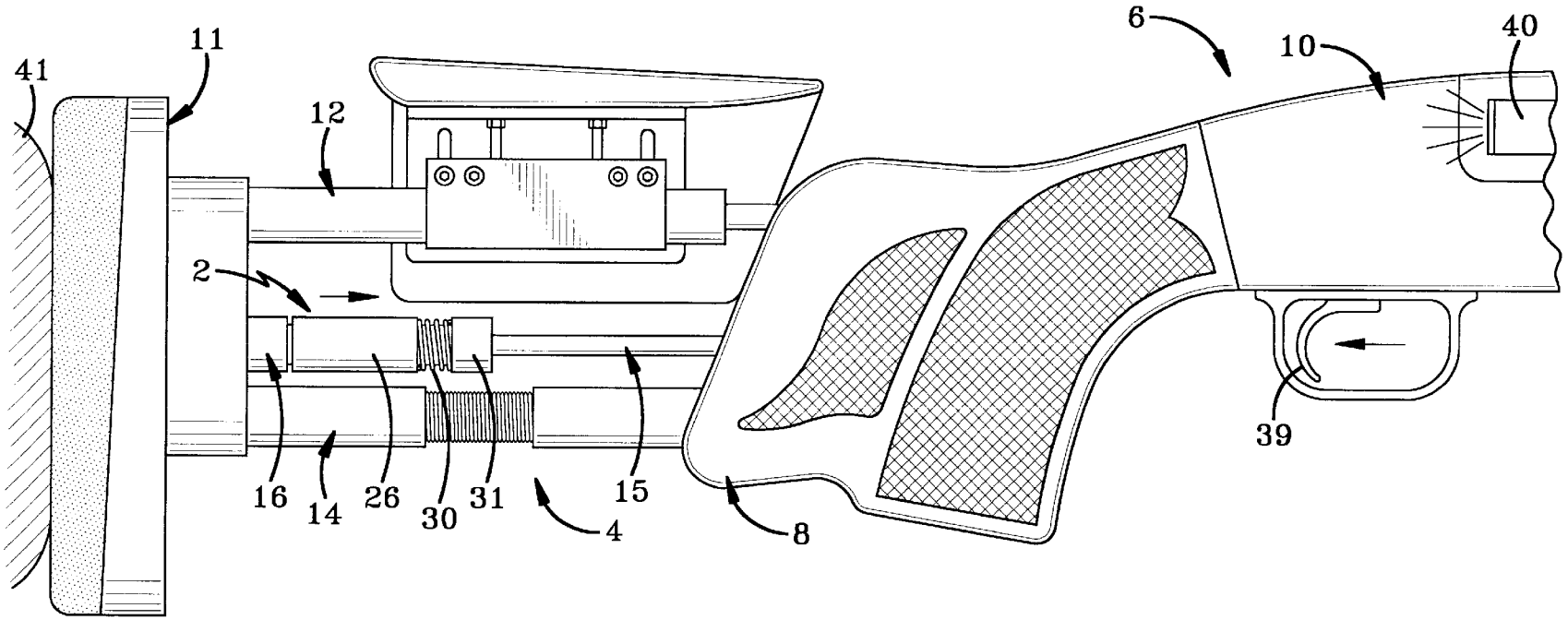
FIG. 4 is a front elevation view of the lock being moved to the unlocked position upon the discharge of a shell in the chamber.
Figure 4A:
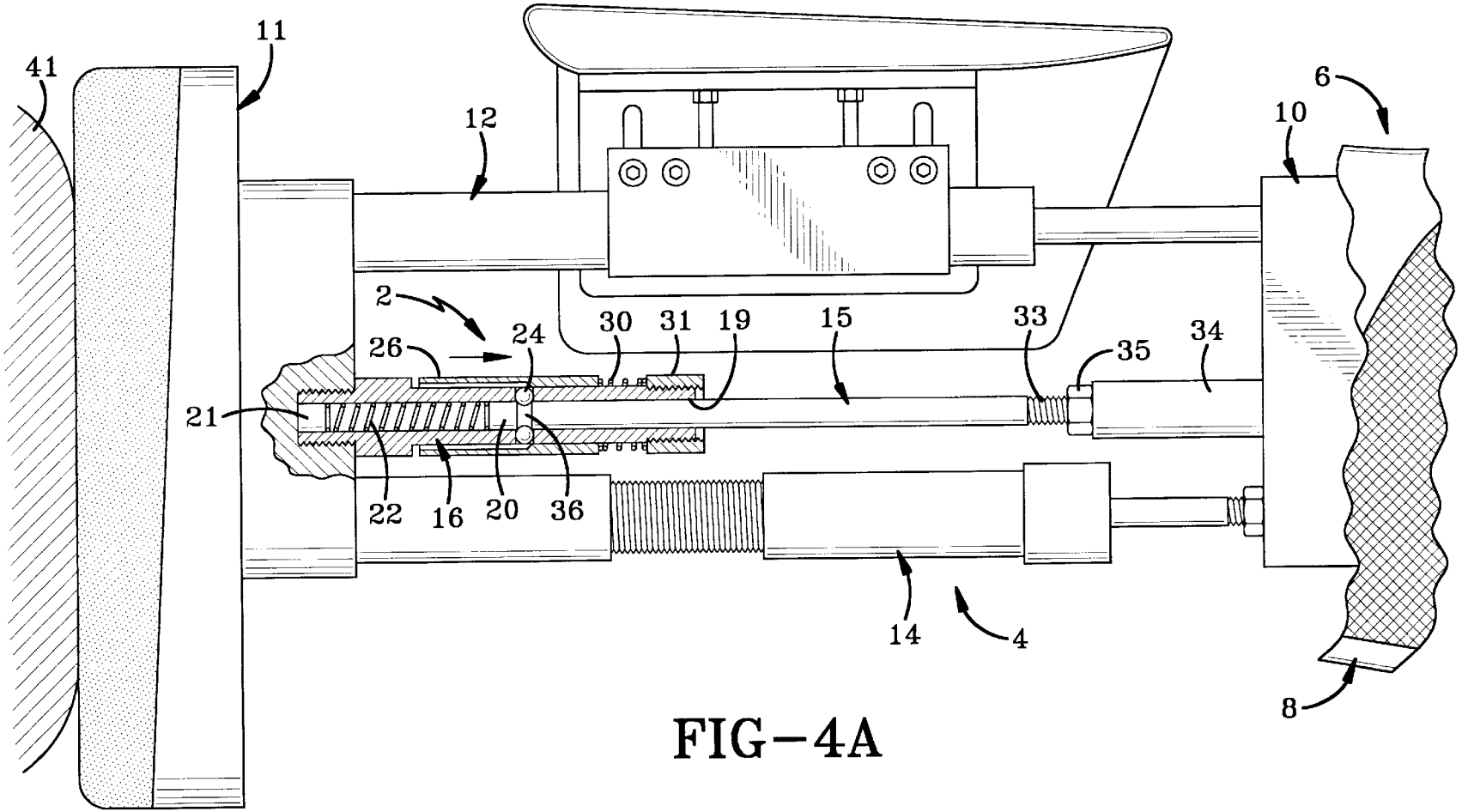
FIG. 4A is a cross sectional view of the lock in the unlocked position.

When the trigger 39 is squeezed by the shooter, a shell 40 is fired from gun 6 as shown in FIG. 4. The explosion of shell 40 immediately forces gun 6 rearwardly with a recoil force and releases lock 2 so that recoil reduction device 4 may be compressed to absorb the recoil force. Lock 2 is released because second sleeve 26 is not secured to the first sleeve 16. The shock force of the explosion forces sleeve 26 relatively forward (compared to first sleeve 16) into an unlocked position as shown in FIGS. 4, 4A, and 4B. The movement is relative because sleeve 26 actually remains substantially stationary while gun 6 recoils rearwardly. Sleeve 26 remains substantially stationary because of its inertia and sliding arrangement. Sleeve 26 may thus be described as an inertia lock.

Figure 5A:
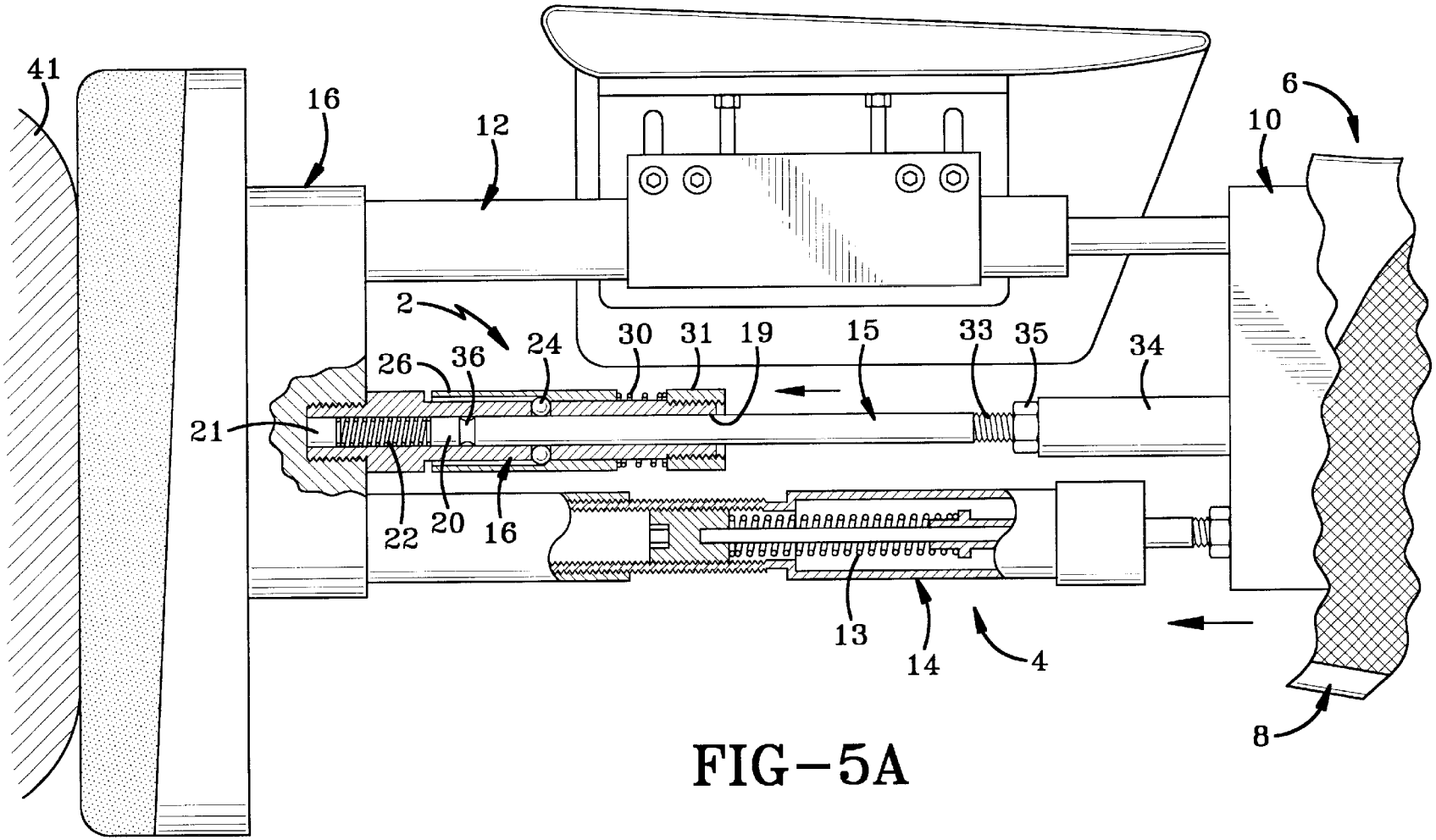
FIG. 5A is a cross sectional view of the recoil reduction device absorbing the recoil force.
Figure 5B:
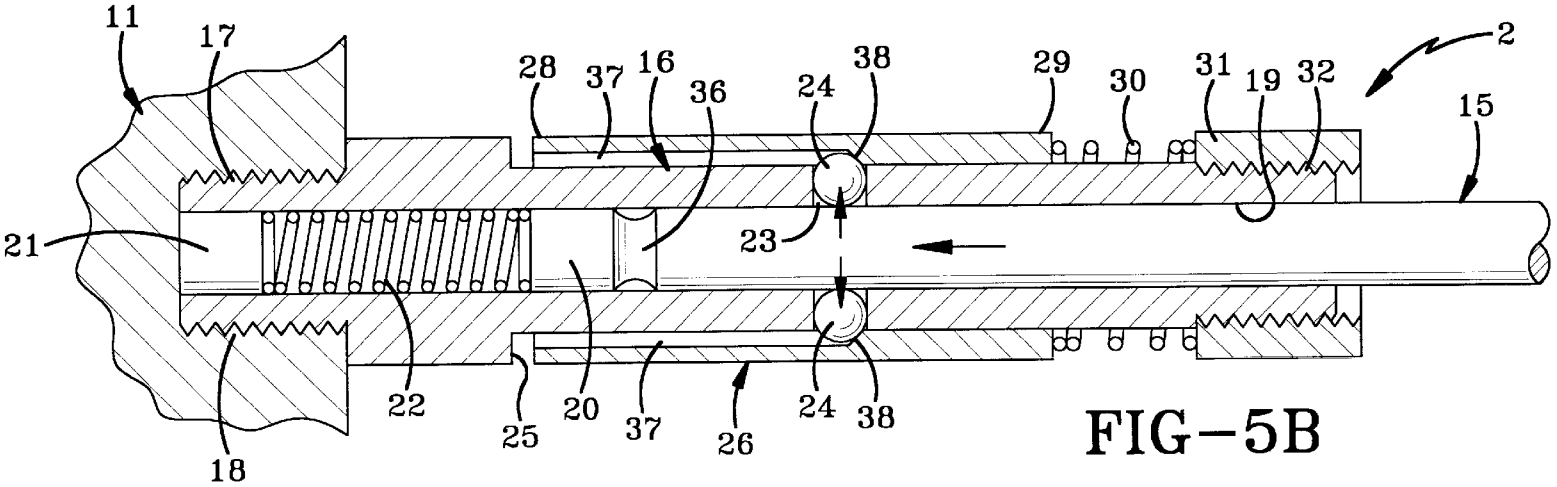
FIG. 5B is an enlarged sectional view of the lock.

Immediately after sleeve 26 moves, shaft 15 moves rearwardly (FIG. 5) and forces ball bearings outwardly along incline 38 into space 37 as shown in FIGS. 5A and 5B. Space 37 is not large enough to fully receive bearing 24 such that ball bearings 24 remain seated in passages 23,23'. Ball bearings 24 are then free of groove 36 allowing shaft 15 to slide relative to first sleeve 16. Shaft 15 may then freely compress spring 22 and allow recoil reduction device 4 to compress and absorb the recoil force in spring 13 (FIG. 5A). The release occurs immediately after gun 6 is fired.

Figure 6B:
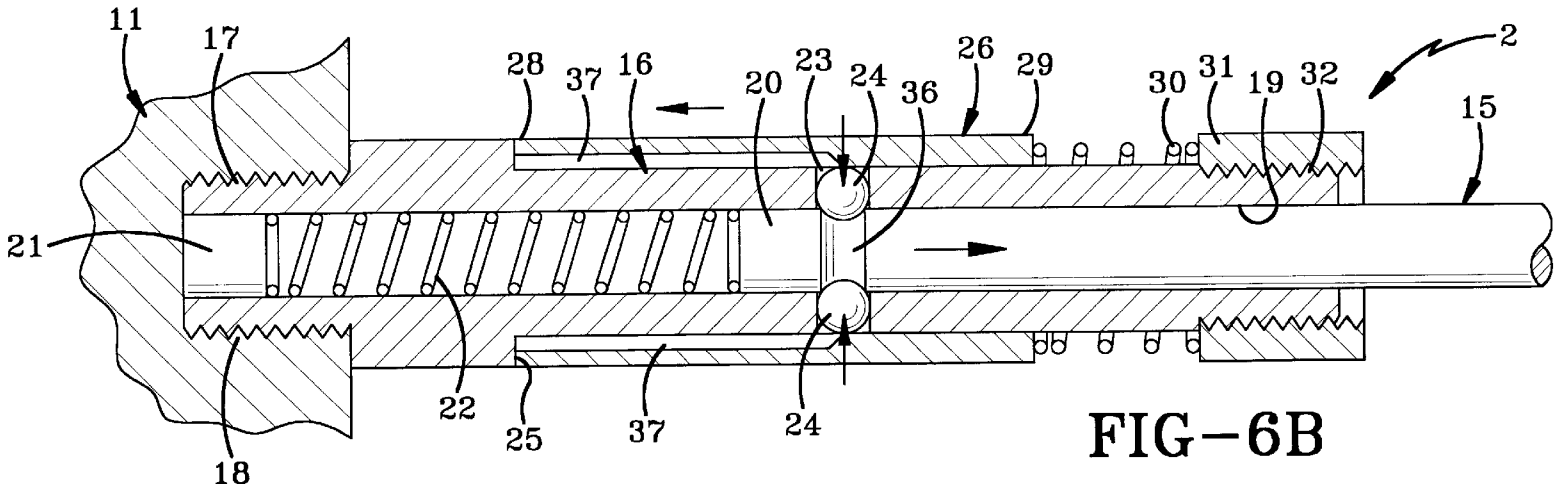
FIG. 6B is an enlarged section of the lock in the locked position.
Figure 6:
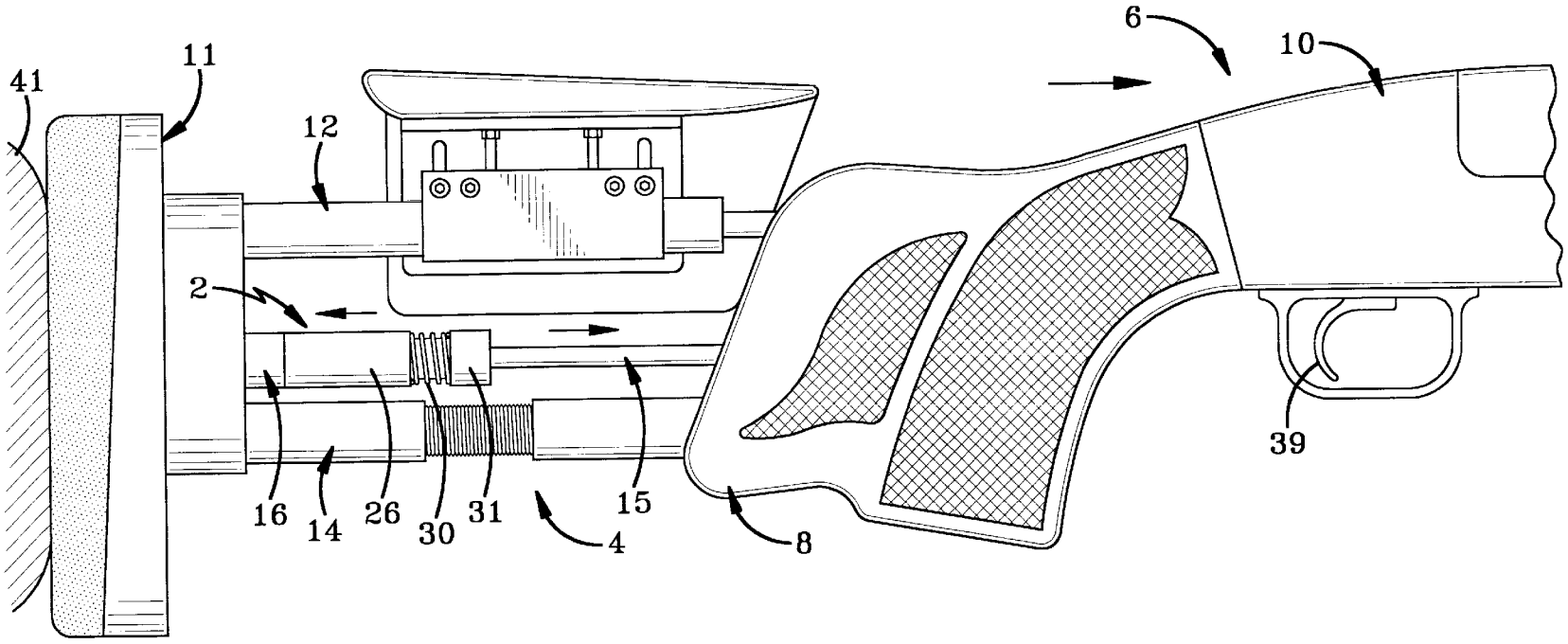
FIG. 6 is a front elevation view of the recoil reduction device expanding after it has absorbed the recoil force and to move the inertia lock back to the locked position.
Figure 6A:
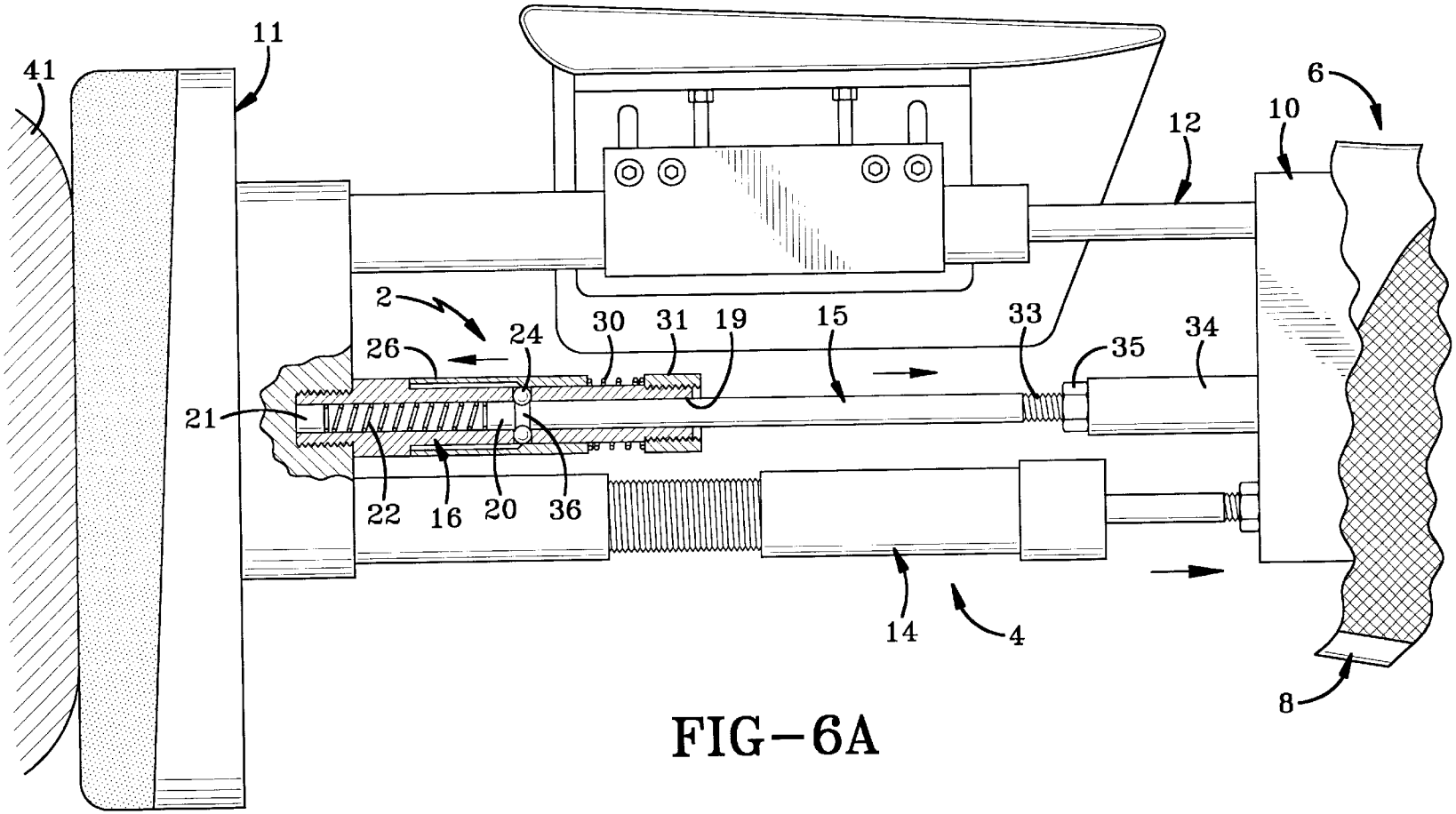
FIG. 6A is a sectional view of the inertia lock after it has moved back into the locked position.

As second sleeve 26 moves forward towards body 10 of gun 6, it compresses compression spring 30 against nut 31. Spring 13 of recoil reduction device 4 then expands forcing stock 8 apart and moving shaft 15 back through sleeve 16 (FIGS. 6 and 6A). Compression spring 30 and spring 22 then begin to expand helping reset lock 2 so that stock 8 with be locked again. As second sleeve 26 moves rearwardly, ball bearings 24 are forced back up incline 38 to the locked position as shown in FIG. 6B. Ball bearings 24 slide back into engagement with groove 36 and shaft 15 is once again held in the locked position.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A recoil reduction lock for a gun stock having a recoil reduction device; the recoil reduction device extending between the gun body and the stock butt; the recoil reduction lock comprising:

a first member adapted to engage the gun body;

a second member adapted to engage the stock butt;

a lock assembly engaging the first and second members and moveable between locked and unlocked positions; the lock being moved to the unlocked position immediately after the gun is fired;

the lock assembly preventing the members from moving relative to each other when the lock is in the locked position such that the user of the gun may mount the gun to his shoulder without compressing the recoil reduction device; and the lock assembly permitting the members to move relative to each other when the lock is in the unlocked position so that the recoil reduction device may compress and absorb the recoil force.

2. The lock of claim 1, wherein the second member is a first sleeve having a longitudinal bore and the first member being a shaft having a first end selectively slidably received in the longitudinal bore of the first sleeve.

3. The lock of claim 2, wherein the shaft has an adjustable length.

4. The lock of claim 2, further comprising a first spring disposed in the bore of the first sleeve; the first spring being disposed adjacent the first end of the shaft.

5. The lock of claim 2, wherein the lock assembly includes a lock member disposed between the shaft and the first sleeve that prevents the shaft from moving relative to the first sleeve.

6. The lock of claim 5, wherein the lock assembly further includes a second sleeve slidably disposed over the first sleeve and moveable between locked and unlocked positions; the second sleeve engaging the lock member.

7. The lock of claim 6, wherein the first end of the shaft defines a groove that seats the lock member.

8. The lock of claim 7, wherein the lock member is at least one ball bearing.

9. The lock of claim 6, wherein the first sleeve includes a shoulder adjacent the first end of the sleeve; the second sleeve abutting the shoulder when the second sleeve is in the locked position.

10. The lock of claim 6, wherein the second sleeve includes an incline; the incline being positioned immediately adjacent the lock member when the second sleeve is in the locked position.

11. The lock of claim 6, further comprising a nut connected to the first sleeve; the nut preventing the second sleeve from sliding off of the first sleeve.

12. The lock of claim 11, further comprising a compression spring disposed between the nut and the second sleeve.

13. The lock of claim 12, wherein the nut is threaded to the first sleeve.

14. A recoil reduction lock for a gun stock having a recoil reduction device; the recoil reduction device extending between the gun body and the stock butt; the recoil reduction lock comprising:

a shaft having a first end and a second end; the shaft adapted to engage the gun body;

the first end of the shaft defining a groove;

a first sleeve having a first end and a second end; the second end adapted to engage the stock butt;

the first sleeve defining at least one passage;

the first sleeve having a longitudinal bore;

the first end of the shaft being selectively slidably received in the longitudinal bore of the first sleeve and moveable between locked and unlocked positions relative to the first sleeve;

a second sleeve slidably disposed over the first sleeve and moveable between locked and unlocked positions; the second sleeve being adapted to move to the unlocked position immediately after the gun is fired by remaining relatively stationary while the first sleeve moves in response to the recoil force; the first sleeve movable to the unlocked position when the second sleeve moves to the unlocked position to allow the recoil reduction device to absorb the recoil force; the second sleeve including an internal incline; the incline being disposed adjacent the passage in the first sleeve when the second sleeve is in the locked position; and a first ball bearing disposed in the passage; the first ball bearing being partially disposed in the groove of the shaft when the shaft is in the locked position.

15. The lock of claim 14, wherein the first sleeve defines a pair of passages that intersect each other at right angles.

16. The lock of claim 15, further comprising second, third, and fourth ball bearings disposed in the passages of the first sleeve.

17. A method for locking a recoil reduction device in a gun stock, the recoil reduction device having a recoil absorption device; the method comprising the steps of:

(a) locking the recoil reduction device with a lock to prevent the recoil absorption device from functioning such that the user of the gun may mount the to his shoulder without compressing the recoil reduction device;

(b) releasing the lock immediately after the gun is fired; and (c) allowing the recoil reduction to absorb the recoil force created by the gun.

18. The method of claim 17, further comprising the step of relocking the recoil reduction device with the lock after the recoil reduction device has absorbed the recoil force.

19. The method of claim 17, wherein step (b) includes the step of using the recoil force of the gun to release the lock.

20. The method of claim 17, wherein step (a) prevents the gun stock from collapsing.

21. A method for firing a gun having a recoil reduction device in the stock of the gun and a recoil reduction lock for the recoil reduction device comprising the steps of:

(a) locking the recoil reduction device with a lock to prevent the recoil reduction device from compressing;

(b) mounting the gun to the user's shoulder;

(c) firing the gun;

(d) releasing the lock immediately after the gun is fired; and (e) allowing the recoil reduction to absorb the recoil force created by the gun.

* * * * *